US008333365B2

(12) United States Patent
Dai

(10) Patent No.: US 8,333,365 B2
(45) Date of Patent: Dec. 18, 2012

(54) HYDRAULIC JACK FOR LONG-TERM SUPPORT

(76) Inventor: Zhiyu Dai, Zhejiang (CN)

( * ) Notice: Subject to any disclaimer, the term of this patent is extended or adjusted under 35 U.S.C. 154(b) by 979 days.

(21) Appl. No.: 12/332,479

(22) Filed: Dec. 11, 2008

(65) Prior Publication Data

US 2010/0078612 A1 Apr. 1, 2010

(30) Foreign Application Priority Data

Sep. 28, 2008 (CN) ..... 2008 1 0121134

(51) Int. Cl.
*B66F 3/25* (2006.01)
*B66F 3/28* (2006.01)

(52) U.S. Cl. ..... 254/93 H; 188/67; 254/2 B; 254/93 R; 254/89 H

(58) Field of Classification Search ..... 254/93 H, 254/93 R, 2 R, 89 H, 2 B, 8 R, 10 B; 188/67
See application file for complete search history.

(56) References Cited

U.S. PATENT DOCUMENTS 1,469,894 A * 10/1923 Clarke ..... 188/67
1,497,218 A * 6/1924 McBride ..... 60/468
1,711,549 A * 5/1929 Stillman ..... 254/93 H
2,455,439 A * 12/1948 Page ..... 188/67
3,918,346 A * 11/1975 Ziegler ..... 89/37.05
4,449,615 A * 5/1984 Beath et al. ..... 188/67

FOREIGN PATENT DOCUMENTS

GB 2152585 A * 8/1985

* cited by examiner

*Primary Examiner* — Lee D Wilson
*Assistant Examiner* — Marc Carlson
(74) *Attorney, Agent, or Firm* — Dickinson Wright PLLC

(57) ABSTRACT

The present invention discloses a hydraulic jack for long-term support. The hydraulic jack for long-term support includes a base, a housing, an oil cylinder, a piston rod, a top cap, a pump body, a pump core, a handle, a press handle, an oil return valve, a press cap and a slit nut. The slit nut surrounds the piston rod and engages with the piston rod via screw threads. The press cap is disposed on upper ends of the slit nut and the top cap and surrounds the piston rod. The present invention can achieve safe and reliable lifting operation.

6 Claims, 3 Drawing Sheets

HYDRAULIC JACK FOR LONG-TERM SUPPORT

CROSS REFERENCE TO RELATED APPLICATION

This present patent application is related to and claims the benefit of Chinese patent application No. 200810121134.3, titled "HYDRAULIC JACK FOR LONG-TERM SUPPORT". The whole content and disclosure of the abovementioned related application is expressly incorporated by reference herein as if fully set forth herein.

FIELD OF THE INVENTION

The present invention relates to a lifting device, and more particularly to a hydraulic jack which can support loads for a long term during lifting operation so as to improve safety of lifting operation.

DESCRIPTION OF RELATED ART

Conventional hydraulic jacks have advantages of compact structures and convenient operation and so on. However, during lifting operation, conventional hydraulic jacks cannot work regularly sometimes because of oil leakage or lowering, so they cannot stay in the lifting operation state for a long term and have poor safety. If operators need work under the raised heavy objects or heavy objects need to be lifted for a long term, then other supporting devices are needed to support the heavy objects to ensure safety, which makes the operation trouble and costs in effort.

SUMMARY OF THE INVENTION

An object of the present invention is to provide a hydraulic jack which can support loads for a long term and improve safety of lifting operation.

To achieve the above-mentioned object, a hydraulic jack for long-term support in accordance with the present invention is provided. The hydraulic jack for long-term support includes a base; a housing; an oil cylinder; a piston rod; a top cap; a pump body; a pump core; a handle; a press handle; an oil return valve; a press cap and a slit nut or half nut; wherein the slit nut surrounds the piston rod and engages with the piston rod via screw threads, the press cap is disposed on upper ends of the slit nut and the top cap and surrounds the piston rod; and the slit nut has an inverted trapezoidal longitudinal section and includes two single elements of which two connection faces have holes in which connection springs are disposed.

Advantageously, an inner wall of the slit nut and an outer wall of the piston rod respectively have opposite sawtooth screw threads formed thereon.

Advantageously, the two connection faces of the two single elements of the slit nut further respectively have holes in which connection pin shafts are disposed.

Advantageously, the press cap and the top cap are connected via two lever mechanisms disposed on two ends thereof, and each lever mechanism includes a bent lever, a compression spring, a connecting rod and a retaining ring, and a middle portion of the bent lever is connected in a notch formed in the press cap via a pin shaft, the pin shaft passes through the upper end of the connecting rod and the connecting rod extends downwards through a through-hole formed in one end of the top cap, the compression spring surrounds a lower portion of the connecting rod, and the retaining ring is disposed on a lower end portion of the connecting rod and blocks the compression spring.

Advantageously, the press cap and the top cap engage with each other via screw threads.

According to the present invention, during the lifting operation of the hydraulic jack, under the action of the connection springs, an upward jacking force is subjected to the slit nut to separate the left single element from the right single element, so that the piston rod can rise normally. When a downward pressure is subjected to the slit nut, the slit nut is closed. Because of the screw thread connection between the slit nut and the piston rod, the slit nut can engage with the piston rod tightly, thereby supporting loads stably. The press cap and the top cap may engage with each other via screw threads or lever mechanisms etc. When the press cap and the top cap engage with each other via screw thread connection, loose the press cap to ensure that the slit nut has a movement space during lifting operation; and tight the press cap when loads are lifted to a desired highness so that the slit nut and the press cap can support the loads stably. When the press cap and the top cap engage with each other via lever connection, during lifting operation, it needn't pull the levers and the slit nut rises under the action of the screw threads on the piston rod while the piston rod rises, and the spring in the slit nut opens the nut, thereby achieving the rising of the piston rod. When loads are lifted to a desired highness, the compression springs, which are disposed on the lower end of the connecting rod connected with the press cap, exert a downward pressure to the slit nut, and the taper angle of the top cap makes the slit nut close to engage with the piston rod tightly, thereby the slit nut and the press cap can support the loads stably. Accordingly, the jack of the present invention is safer and more reliable for use. The connection pin shafts disposed in the slit nut can ensure that the two single elements of the slit nut can move back to be firmly reconnected with each other after separating from each other.

DETAILED DESCRIPTION OF THE PREFERRED EMBODIMENTS

Figure 1:
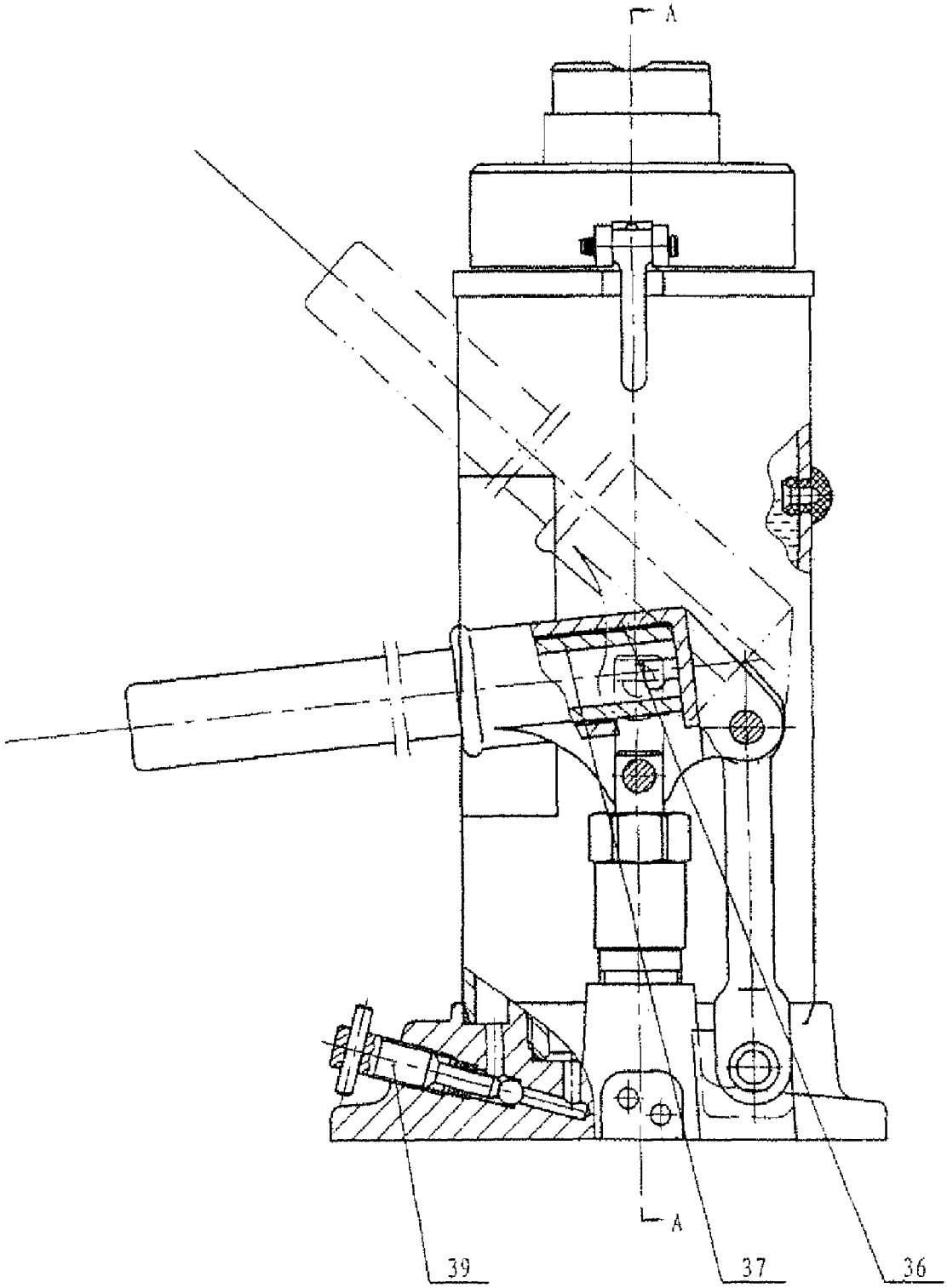
FIG. 1 is a structural schematic view of an exterior of a jack of the present invention.
Figure 2:
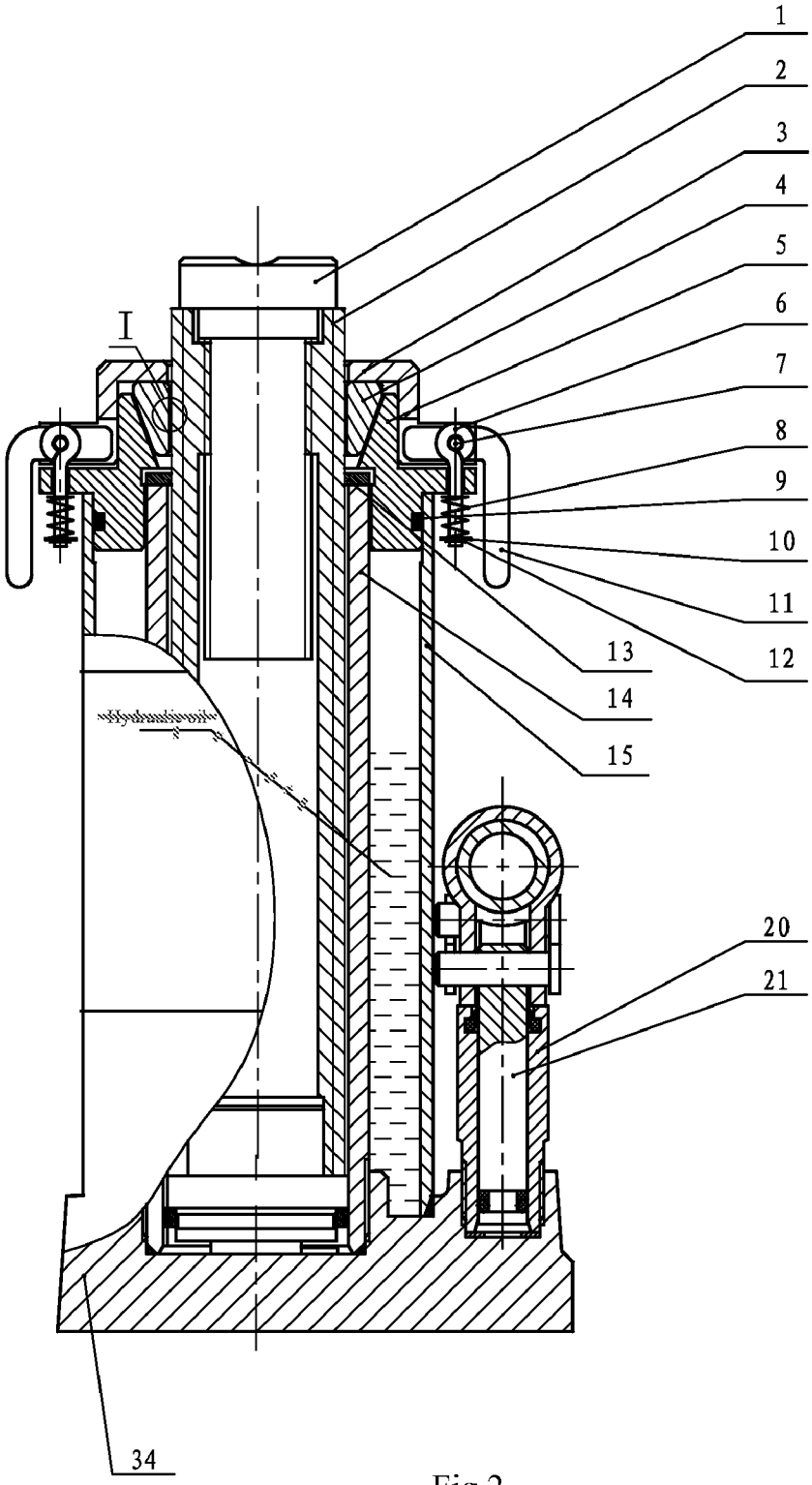
FIG. 2 is a partially cross-sectional view taken along lines A-A in FIG. 1.
Figure 6:
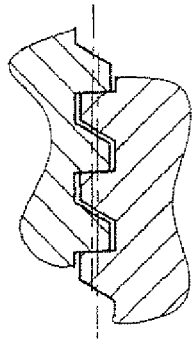
FIG. 6 is an enlarged view of part I in FIG. 2.

As shown in FIG. 1 and FIG. 2, a hydraulic jack according to the present invention includes a base 34, a housing 15, an oil cylinder 14, a piston rod 2, an adjustment screw rod 1, a top cap 5, a pump body 20, a pump core 21, a handle 37, a press handle 36, an oil return valve 39, a press cap 3, a slit nut 4 and lever mechanisms. An O-shaped seal ring 9 is disposed between the housing 15 and the top cap 5, and a retaining ring 13 is disposed between the upper end of the oil cylinder 14 and the top cap 5. The slit nut 4 surrounds the piston rod 2. The slit nut 4 and the piston rod 2 respectively have opposite sawtooth screw threads formed on outer walls thereof, and engage with each other, as shown in FIG. 6. The press cap 3 is disposed on the upper end of the slit nut 4, surrounding the piston rod 2. The press cap 3 and the top cap 5 are connected via two lever mechanisms disposed on two sides thereof. The press cap is provided with two through holes at two sides. Each lever mechanism includes a bent lever 11, a compression spring 8, a connecting rod 6, a gasket 10 and a retaining ring 12, wherein the middle portion of the bent lever 11 is connected in a notch formed in the press cap 3 via a pin shaft 7, the pin shaft 7 passes through the upper end of the connecting rod 6 and the connecting rod 6 extends downwards through a hole formed on one side of the top cap 5, the compression spring 8 surrounds the lower portion of the connecting rod 6, and the retaining ring 12 is disposed on the lower end portion of the connecting rod 6 and blocks the compression spring 8. Of course, in the structure of the hydraulic jack of the present invention, the press cap 3 and the top cap 5 may be connected via a simple screw thread connection structure, which is relatively inconvenient for operation.

Figure 3:
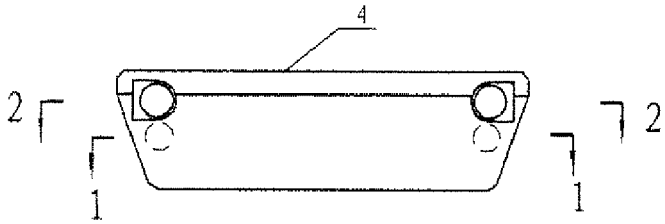
FIG. 3 is a structural schematic view of a slit nut.
Figure 4:
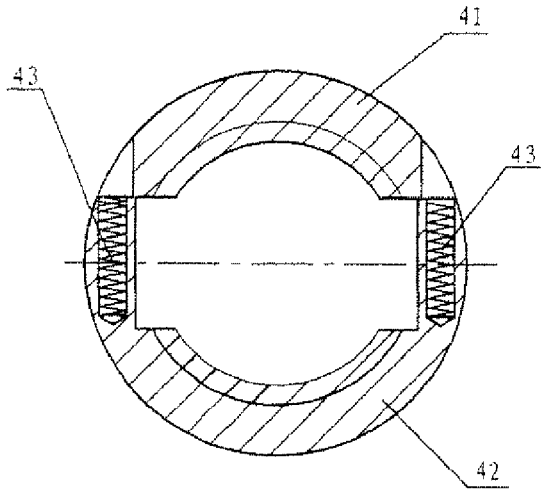
FIG. 4 is a cross-sectional view taken along lines 1-1 in FIG. 3.
Figure 5:
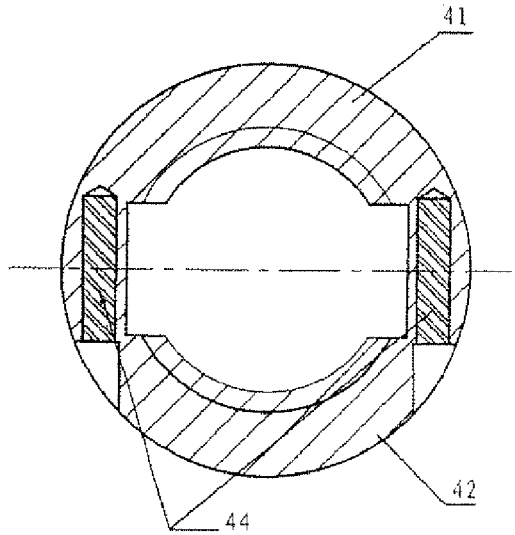
FIG. 5 is a cross-sectional view taken along lines 2-2 in FIG. 3.

As shown in FIG. 3, the longitudinal section of the slit nut 4 is inverted trapezoidal. As shown in FIG. 4, the slit nut 4 includes a left single element 41 and a right single element 42. Two connection faces of the two single elements 41, 42 have holes formed therein, in which connection springs 43 are disposed. As shown in FIG. 5, the two connection faces of the two single elements 41, 42 are further respectively provided with holes formed therein for receiving connection pin shafts 44.

According to the present invention, the slit nut 4 and the piston rod 2 may also be connected by triangular screw threads, trapezoidal screw threads or other screw threads with other shapes.

The invention has been described in an illustrative manner, and it is to be understood that the embodiment which has been used is intended to explain the invention rather than limitation. Obviously, many modifications and variations of the present invention are possible in light of the above teachings, and the invention may be practiced otherwise than as specifically described.

What is claimed is:

1. A hydraulic jack for long-term support, comprising:

a base;

a housing;

an oil cylinder;

a piston rod;

a top cap;

a pump body;

a pump core;

a handle;

a press handle and an oil return valve;

a slit nut surrounding the piston rod and engaging with the piston rod via screw threads, the slit nut having an inverted trapezoidal longitudinal section and including two single elements of which two connection faces are provided with holes in which connection springs are disposed wherein the two connection faces of the two single elements of the slit nut are further respectively provided with holes in which connection pin shafts are disposed; and a press cap, disposed on upper ends of the slit nut and the top cap and surrounding the piston rod.

2. The hydraulic jack for long-term support as claimed in claim 1, wherein an inner wall of the slit nut and an outer wall of the piston rod respectively have opposite sawtooth screw threads formed thereon.

3. The hydraulic jack for long-term support as claimed in claim 1, wherein the press cap and the top cap are connected via two lever mechanisms disposed on two sides thereof, the press cap is provided with two through holes at two sides, and each lever mechanism includes a bent lever, a compression spring, a connecting rod and a retaining ring, and a middle portion of the bent lever is connected in a notch formed in the press cap via a pin shaft, the pin shaft passes through the upper end of the connecting rod and the connecting rod extends downwards through the hole of the top cap, the compression spring surrounds a lower portion of the connecting rod, and the retaining ring is disposed on a lower end portion of the connecting rod and blocks the compression spring.

4. The hydraulic jack for long-term support as claimed in claim 1, wherein the press cap and the top cap engage with each other via screw threads.

5. The hydraulic jack for long-term support as claimed in claim 2, wherein the press cap and the top cap are connected via two lever mechanisms disposed on two sides thereof, the press cap is provided with two through holes at two sides, and each lever mechanism includes a bent lever, a compression spring, a connecting rod and a retaining ring, and a middle portion of the bent lever is connected in a notch formed in the press cap via a pin shaft, the pin shaft passes through the upper end of the connecting rod and the connecting rod extends downwards through the hole of the top cap, the compression spring surrounds a lower portion of the connecting rod, and the retaining ring is disposed on a lower end portion of the connecting rod and blocks the compression spring.

6. The hydraulic jack for long-term support as claimed in claim 2, wherein the press cap and the top cap engage with each other via screw threads.

* * * * *